US011643837B2

(12) United States Patent
Chen et al.

(10) Patent No.: US 11,643,837 B2
(45) Date of Patent: May 9, 2023

(54) TENT FRAME, UNIT TENT AND EXTENDABLE CUBIC TENT GROUP

(71) Applicant: Superb Tent Co., Ltd, Guangdong (CN)

(72) Inventors: Ryan Chen, Guangdong (CN); Guy Huang, Guangdong (CN); Tony Zhen, Guangdong (CN)

(73) Assignee: Superb Tent Co., Ltd, Foshan (CN)

( * ) Notice: Subject to any disclaimer, the term of this patent is extended or adjusted under 35 U.S.C. 154(b) by 242 days.

(21) Appl. No.: 17/284,783

(22) PCT Filed: Nov. 5, 2020

(86) PCT No.: PCT/CN2020/126755
§ 371 (c)(1),
(2) Date: Apr. 12, 2021

(87) PCT Pub. No.: WO2021/143304
PCT Pub. Date: Jul. 22, 2021

(65) Prior Publication Data

US 2022/0127874 A1 Apr. 28, 2022

(30) Foreign Application Priority Data

Jan. 19, 2020 (CN) ..... 202010060260.3

(51) Int. Cl.
*E04H 15/44* (2006.01)
*E04H 15/18* (2006.01)
(Continued)

(52) U.S. Cl.
CPC ..... *E04H 15/44* (2013.01); *E04H 15/18* (2013.01); *E04H 15/20* (2013.01); *E04H 15/26* (2013.01)

(58) Field of Classification Search
CPC ..... E04H 15/44; E04H 15/60
See application file for complete search history.

(56) References Cited

U.S. PATENT DOCUMENTS 4,571,897 A * 2/1986 Kerr ..... E04D 13/032 52/13
5,564,234 A * 10/1996 Vermeulen ..... A01G 9/227 52/63

(Continued)

FOREIGN PATENT DOCUMENTS

CN 103741891 A 4/2014
CN 204782233 U 11/2015

(Continued)

*Primary Examiner* — Noah Chandler Hawk

(57) ABSTRACT

Disclosed is a tent frame, a unit tent and an extendable cubic tent group. The tent group is assembled from a plurality of unit tents sharing edge structures. The unit tent consists of an inflatable tarpaulin and a tent frame. The tent frame includes bases, columns and beams. The beam is provided with at least a first water channel and a second water channel in a length direction. The present invention is simplified in the structures of the columns and the beams, which is more beneficial to coping with the situation of large water volume. Besides, the assembly of small parts can be reduced, and the stability of the structure can be enhanced, so that the structural weight of the overall frame is greatly reduced while the hidden water discharge function is reserved.

13 Claims, 19 Drawing Sheets

(51) Int. Cl.
*E04H 15/20* (2006.01)
*E04H 15/26* (2006.01)

(56) References Cited

U.S. PATENT DOCUMENTS

| | | | | |
|---|---|---|---|---|
| 6,345,638 | B1 * | 2/2002 | Warner | E04H 15/644 52/222 |
| 7,610,733 | B2 * | 11/2009 | Rizzotto | E04C 3/11 52/156 |
| 10,392,821 | B2 * | 8/2019 | Volin | E04B 1/19 |

FOREIGN PATENT DOCUMENTS

| | | | | |
|---|---|---|---|---|
| CN | 107269107 | A | 10/2017 | |
| CN | 207194601 | U | 4/2018 | |
| CN | 207469541 | U | 6/2018 | |
| CN | 108589912 | A | 9/2018 | |
| FR | 2901820 | A1 * | 12/2007 | E04H 15/18 |

* cited by examiner

TENT FRAME, UNIT TENT AND EXTENDABLE CUBIC TENT GROUP

TECHNICAL FIELD

The present invention relates to the technical field of tents, in particular to a tent frame, a unit tent and an extendable cubic tent group.

BACKGROUND ART

Tents have the characteristics of stable structure, beautiful appearance and convenient assembly and disassembly. Outdoor tents are used in many outdoor activities, such as celebration banquets, events, and exhibitions. A tent is mainly assembled by disposing a tarpaulin outside a main frame. The existing tents have a great variety of types, including single-top or multi-unit assembled tents. The existing assembled tents have the problem of inconvenience in water discharge. The Chinese Patent No. CN201720905621.3 proposes a modular tent group with good water discharge, which specifically discloses that the structures of beams and columns are designed so that water is directly discharged to the ground along the beams and columns to form a hidden water discharge system. However, the above patent is too complicated in the design of the structure of the beams and the structure of the connection between the beam and the column, so that the overall weight and material cost of the beams are relatively high, and it is difficult for this structure of beams to cope with the situation of large water volume.

Therefore, the prior art needs to be improved and developed.

SUMMARY OF THE INVENTION

The present invention is directed to a tent frame, a unit tent and an extendable cubic tent group, which aims to solve the technical problems that the existing modular tent group is too complicated in the design of the structure of beams when using the beams to form the water discharge system, so that the overall weight and material cost of the beams are relatively high, and it is difficult for the structure of beams to cope with the situation of large water volume.

The technical solutions of the present invention are as follows:

A tent frame includes bases, columns and beams. The base is disposed at a bottom of the column. The beam is provided with at least a first water channel and a second water channel in a length direction. The first water channel is disposed on an upper surface of the beam. Two sides of the first water channel are provided with tarpaulin top clamping positions. The second water channel is disposed in the beam and located below the first water channel. A plurality of water leakage holes are formed in a bottom surface of the first water channel at intervals. A third water channel is disposed in the column in a length direction. The beam is disposed at a top end of the column. Ports of the first water channel and the second water channel communicate with a port of the third water channel.

According to the tent frame, the shape of a concave surface of the first water channel is a trapezoid. The tarpaulin top clamping positions are disposed at top ends of the two sides of the first water channel.

According to the tent frame, the tent frame further includes curtain clamping positions. The shape of a concave surface of the second water channel is larger at the top and smaller at the bottom. The curtain clamping positions are disposed at bottom ends of two outer sides of the second water channel.

According to the tent frame, the beam is connected to the column through a transition connector. The transition connector includes a vertical insertion portion, horizontal insertion portions and tent top insertion portions. A transition water channel is disposed in the vertical insertion portion in a length direction, with its lower end forming an insertion with the column. The number of the horizontal insertion portions is at least two. The horizontal insertion portions are disposed at side edges of a top end of the vertical insertion portion to form an insertion with the beam. The tent top insertion portion is disposed at a connection between two adjacent horizontal insertion portions, and an opening faces the inside of the tent frame.

According to the tent frame, the horizontal insertion portion includes a bottom plate, a first side plate and a second side plate. The bottom plate is disposed at the side edge of the vertical insertion portion to support the beam. The first side plate and the second side plate are respectively disposed on two sides of the bottom plate.

According to the tent frame, the base includes a pedestal, a base plate and a water retaining plate. The pedestal is disposed on the base plate. A fourth water channel is disposed in the pedestal in a length direction. The pedestal forms an insertion with an end portion of the column. The port of the third water channel communicates with a port of the fourth water channel. The port of the fourth water channel extends to a bottom of the pedestal to form a water outlet. The water retaining plate is disposed on the base plate and surrounds an edge of the pedestal except for the position of the water outlet.

According to the tent frame, the tent frame further includes a spring pin assembly. The spring pin assembly includes a sleeve, a pressure plate, a spring and a spring dowel pin. The pressure plate is disposed at a side surface of the pedestal, and a circular hole is formed in a surface of the pressure plate. A port of the sleeve is connected to the pressure plate and is opposite to the circular hole, and the sleeve is located in the pedestal. The spring is disposed in the sleeve. A rear end of the spring dowel pin is disposed in front of the spring, and a front end runs through the circular hole to press against an inner surface of the column.

According to the tent frame, the tent frame further includes tent top rods and a confluence member The confluence member is provided with a plurality of confluence positions at intervals along a side surface. One end of the tent top rod forms an insertion with the tent top insertion portion, and the other end is connected to one of the confluence positions of the confluence member.

According to the tent frame, a top of the confluence member is provided with a propping position, and a propping rod runs through the propping position to prop up a tarpaulin. The propping rod includes a top tray, a brace rod and a lifting rod. An upper end of the brace rod is connected to the top tray, a lower end is connected to the lifting rod, and the lifting rod is inserted at the propping position.

A unit tent includes a tent frame and a tarpaulin. The tent frame uses the tent frame as described above. An edge of the tarpaulin is provided with a tarpaulin sleeve and a tarpaulin rod. The tarpaulin rod runs through the tarpaulin sleeve, and they run through the tarpaulin top clamping position together such that the edge of the tarpaulin is located above the first water channel.

According to the unit tent, the tarpaulin is an inflatable tarpaulin. An edge of the tarpaulin sleeve is provided with a lappet configured to shield the tarpaulin sleeve, and the lappet is located above the first water channel.

According to the unit tent, the unit tent further includes wall panel connectors. The wall panel connectors are respectively disposed oppositely between every two adjacent columns, and a wall panel is mounted between the two wall panel connectors. The wall panel connector is in a C shape. An outer side is provided with an L-shaped end to form an insertion with a side surface of the column. An anti-scratch strip is disposed at a close position of the outer side and the side surface of the column. An anti-scratch strip is disposed at a closes position of an opening and the wall panel.

An extendable cubic tent group includes a plurality of tarpaulins and a plurality of tent frames. The tent frame uses the tent frame as described above. Every two adjacent tent frames share the beams and the columns, and one of the columns is provided with at least four of the beams. The tarpaulin is mounted on the tent frame, and an edge of the tarpaulin is located above the first water channel.

Beneficial effects: The present invention provides a tent frame, a unit tent and an extendable cubic tent group. The tent group is assembled from a plurality of unit tents sharing edge structures. The unit tent consists of an inflatable tarpaulin and a tent frame having a water discharge function. According to the tent frame, the structures of the columns and the beams are simplified. The column is provided with a single water guide channel, and a water guide channel of the beam is set as two layers communicating with each other and is in a shape of a trapezoid. The tent frame is simple in structure, but is more beneficial to coping with the situation of large water volume. Besides, the connector of the column and the beam is made into an integrated structure according to different positions, which reduces the assembly of small parts during assembly and effectively enhances the stability of the structure, so that the structural weight of the overall frame is greatly reduced while the hidden water discharge function is reserved.

DETAILED DESCRIPTION OF THE INVENTION

Figure 1:
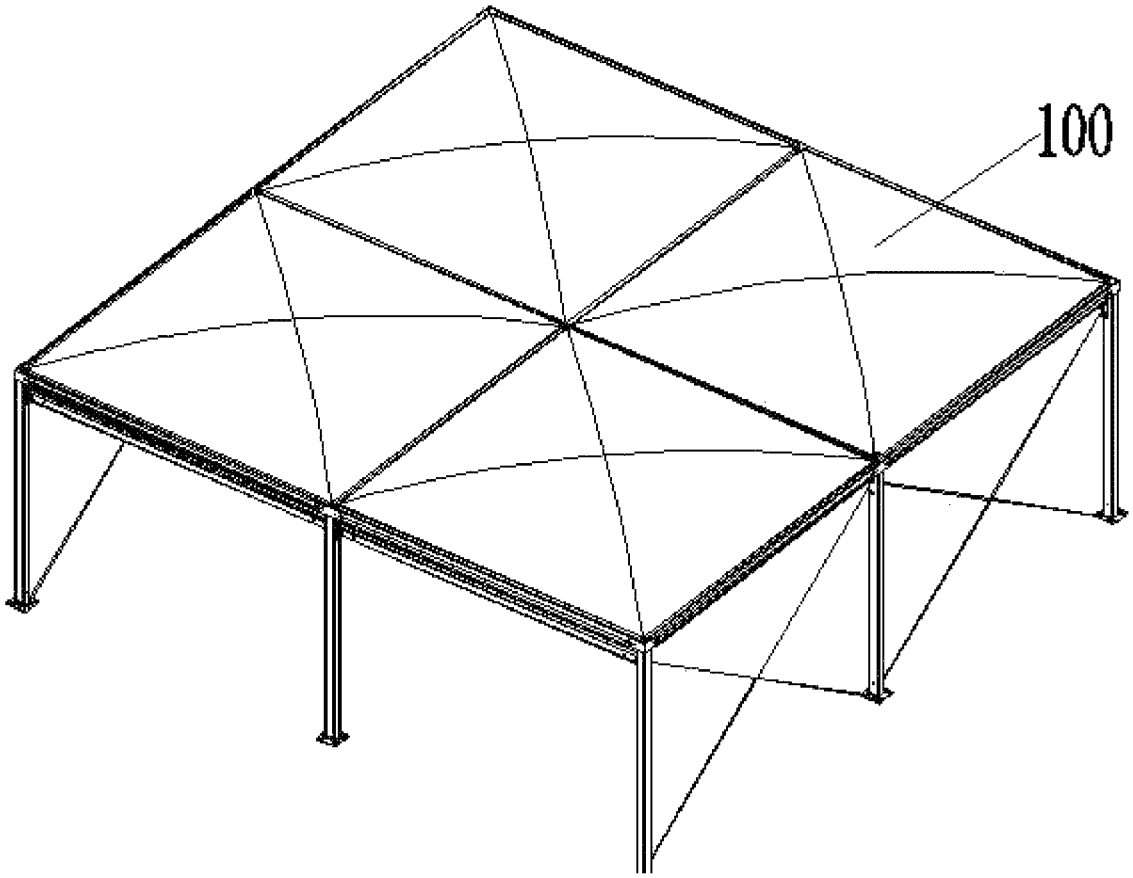
FIG. 1 is a schematic structural diagram of a square extendable cubic tent group.

Implementations of the present invention are described in detail below, and the examples of the implementations are illustrated in the drawings. The same or similar reference numerals throughout indicate the same or similar elements or elements, or elements having the same or similar functions. The implementations described below with reference to the drawings are exemplary, are only intended to be illustrative of the present invention and cannot to be construed as limitation of the present invention.

In the description of the present invention, it should be understood that orientations or positional relations indicated by terms such as "center", "longitudinal", "horizontal", "length", "width", "thickness", "upper", "lower", "front", "rear", "left", "right", "vertical", "horizontal", "top", "bottom", "inner", "outer", "clockwise" and "counterclockwise" are orientations or positional relations shown by the drawings and are only intended to facilitate and simplify the description of the present invention rather than to indicate or imply that the specified devices or elements must have specific orientations and be structured or operated according to the specific orientations, and therefore cannot be construed as limitation of the present invention. In addition, terms "first" and "second" are only for descriptive purposes, but cannot be construed as indicating or implying relative importance or implicitly indicating the number of the specified technical features. Therefore, features defined by "first" and "second" may explicitly or implicitly include one or more of the features. In the description of the present invention, "a plurality of" mean two or more, unless otherwise explicitly defined.

In the description of the present invention, it should be noted that unless otherwise explicitly specified and defined, the understanding of terms "installed", "linked" and "connected" should be generalized, for example, it may be fixed connection, detachable connection or integral connection; it may be mechanical connection, electrical connection or communication with each other; and it may be direct link, indirect link through an intermediate, communication between the interiors of two elements or an interactive relation between two elements. For those of ordinary skill in the art, the specific meanings of the aforementioned terms in the present invention may be understood according to specific circumstances.

In the present invention, unless otherwise explicitly specified or defined, the first feature being "on" or "beneath" the second feature may include the first feature being in direct contact with the second feature or the first feature being in contact with the second feature through another feature therebetween rather than in direct contact with the second feature. Also, the first feature being "on", "over" and "above" the second feature includes the first feature being over and above the second feature, or only represents that the level of the first feature is higher than the level of the second feature. The first feature being "beneath", "under" and "below" the second feature includes the first feature being under and below the second feature, or only represents that the level of the first feature is lower than the level of the second feature.

The disclosure hereinafter provides a lot of different implementations or examples to implement different structures of the present invention. In order to simplify the disclosure of the present invention, the components and configurations of specific examples are described hereinafter. Certainly, they are only examples and are not intended to limit the present invention. In addition, the present invention may repeat reference numbers or reference letters in different examples, and such repetition is for the purpose of simplicity and clarity, and does not indicate the relation between various implementations and/or configurations discussed. In addition, although the present invention provides examples of various specific processes and materials, those of ordinary skill in the art can realize the application of other processes and/or the use of other materials.

Figure 2:
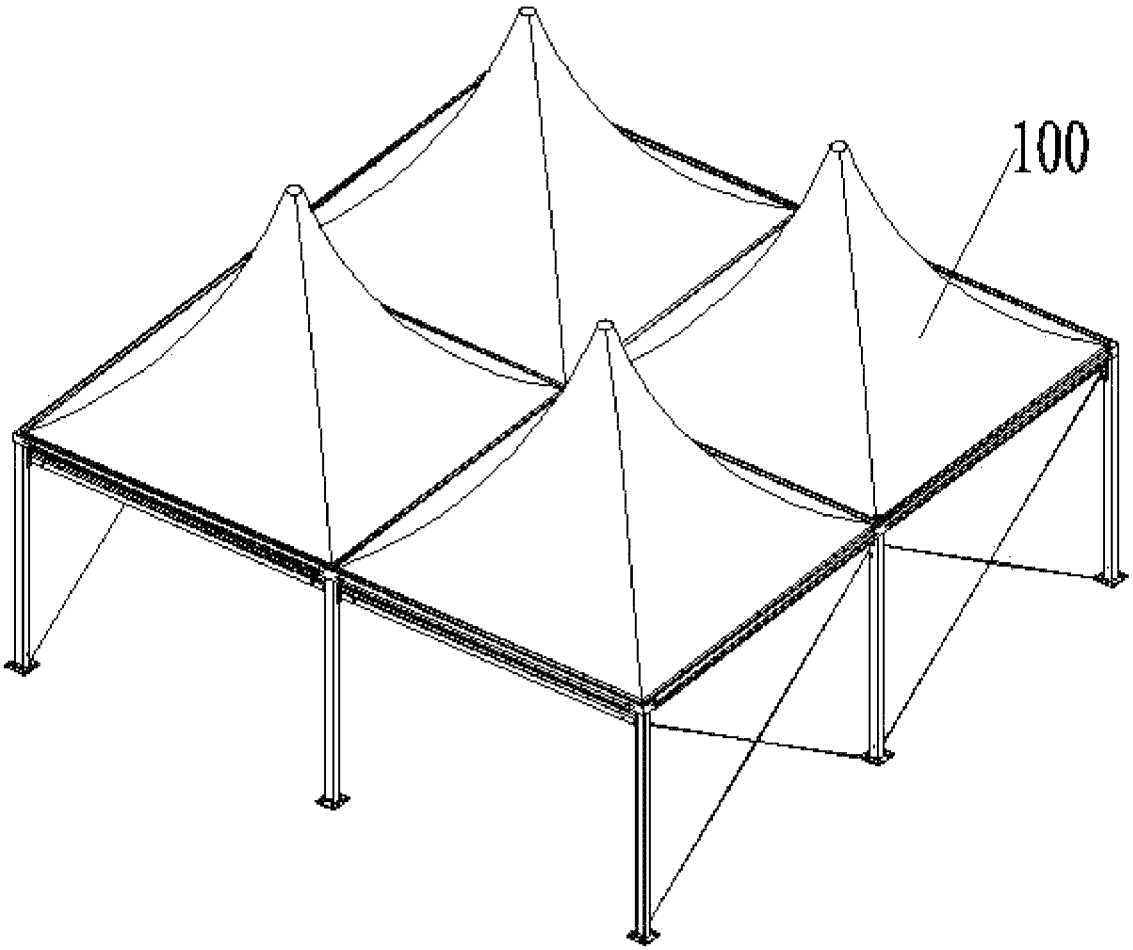
FIG. 2 is a schematic structural diagram of a steepletop extendable cubic tent group.

Referring to FIG. 1 and FIG. 2, FIG. 1 and FIG. 2 are schematic structural diagrams of extendable cubic tent groups in an embodiment of the present invention. The extendable cubic tent group is assembled from a plurality of unit tents (100) sharing edge structures. FIG. 1 shows a square tent group, and FIG. 2 shows a steepletop tent group.

Figure 3:
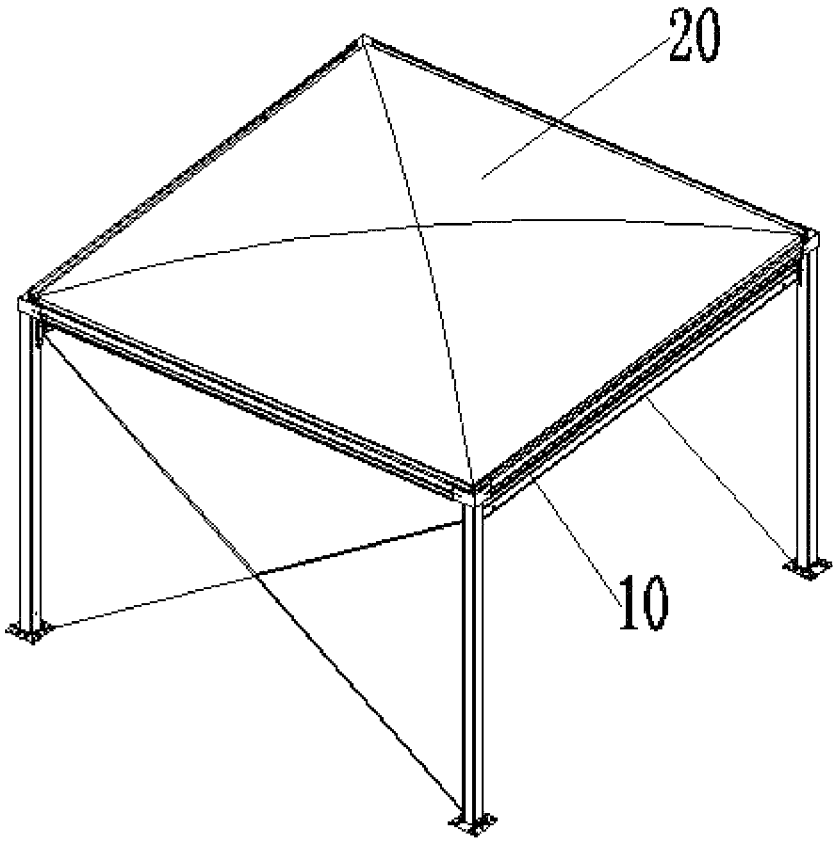
FIG. 3 is a schematic structural diagram of a square unit tent.
Figure 4:
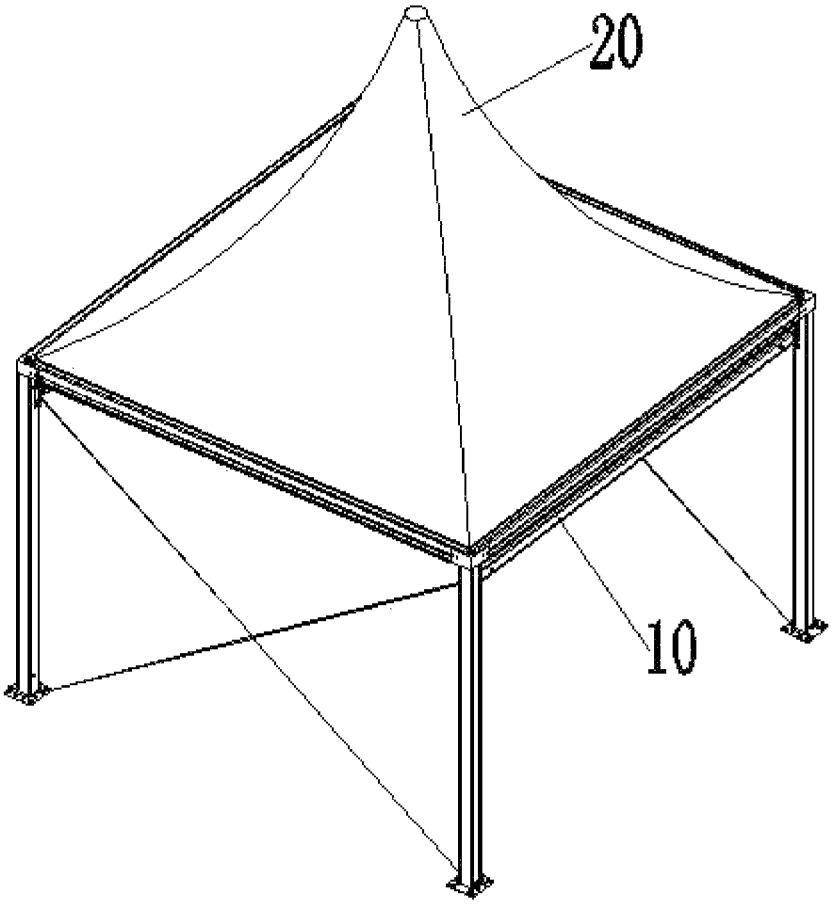
FIG. 4 is a schematic structural diagram of a steepletop unit tent.

Specifically, referring to FIG. 3 and FIG. 4, the unit tent (100) includes a tent frame (10) and a tarpaulin (20).

Figure 5:
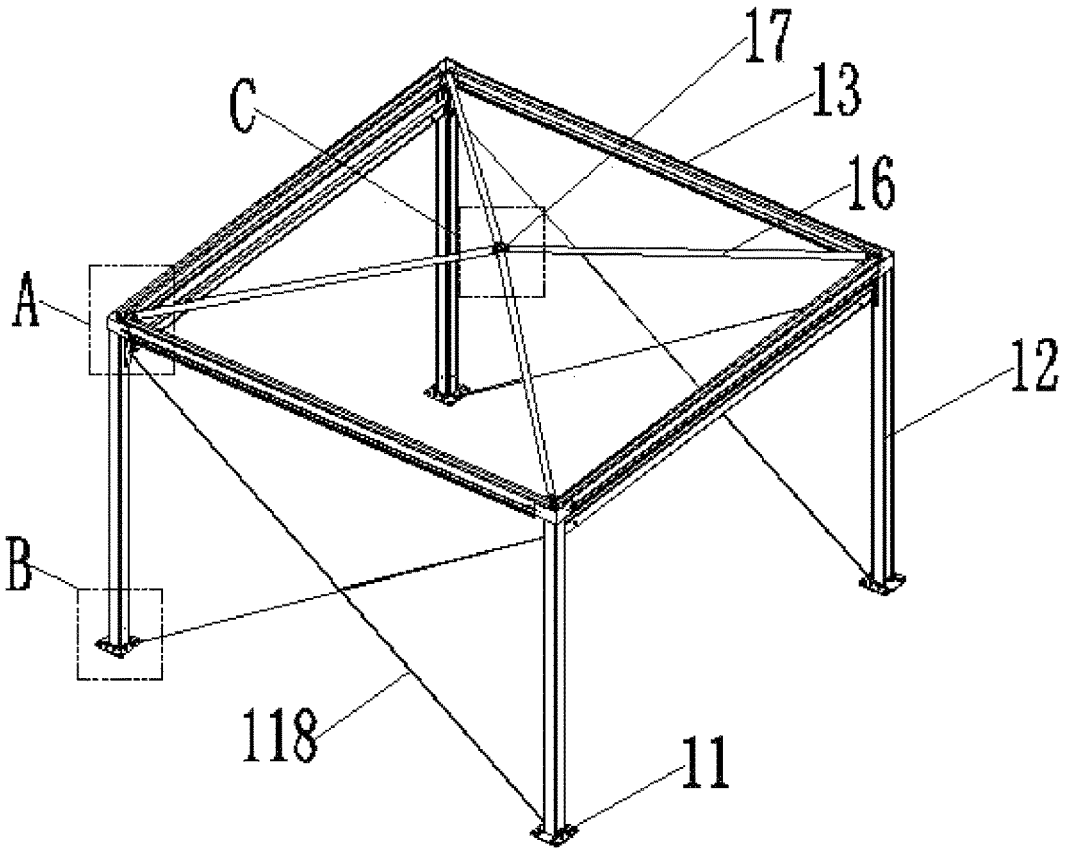
FIG. 5 is a schematic structural diagram of a tent frame of a square unit tent.

Specifically, referring to FIG. 5, the tent frame (10) includes bases (11), columns (12) and beams (13). The base (11) is disposed at a bottom of the column (12).

Figure 6:
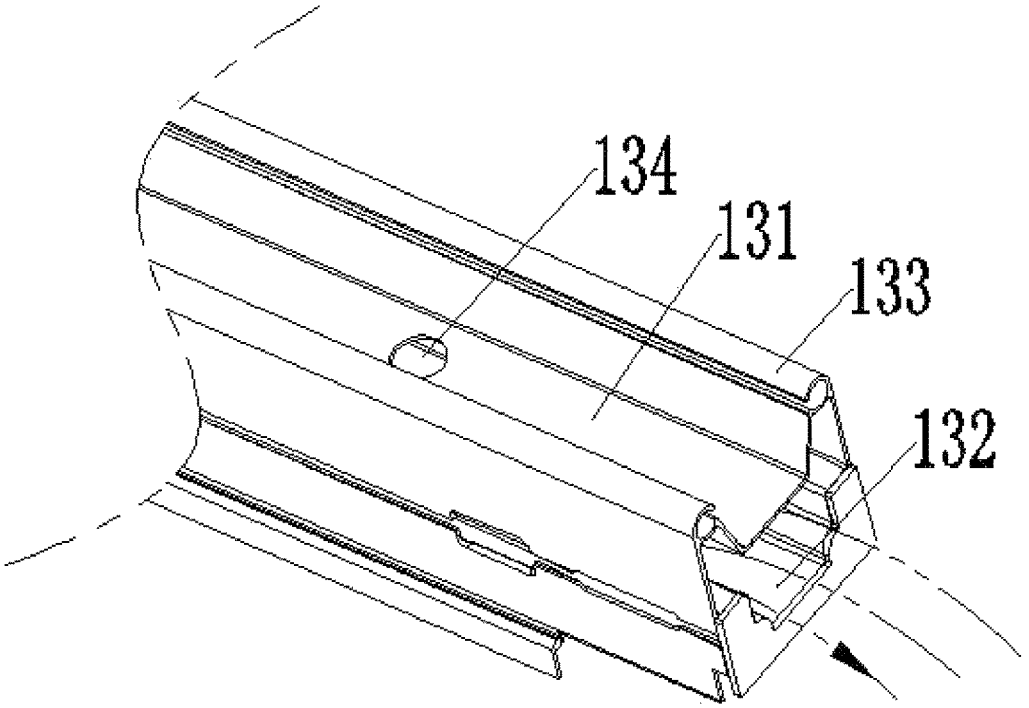
FIG. 6 is a schematic structural diagram of a beam.
Figure 7:
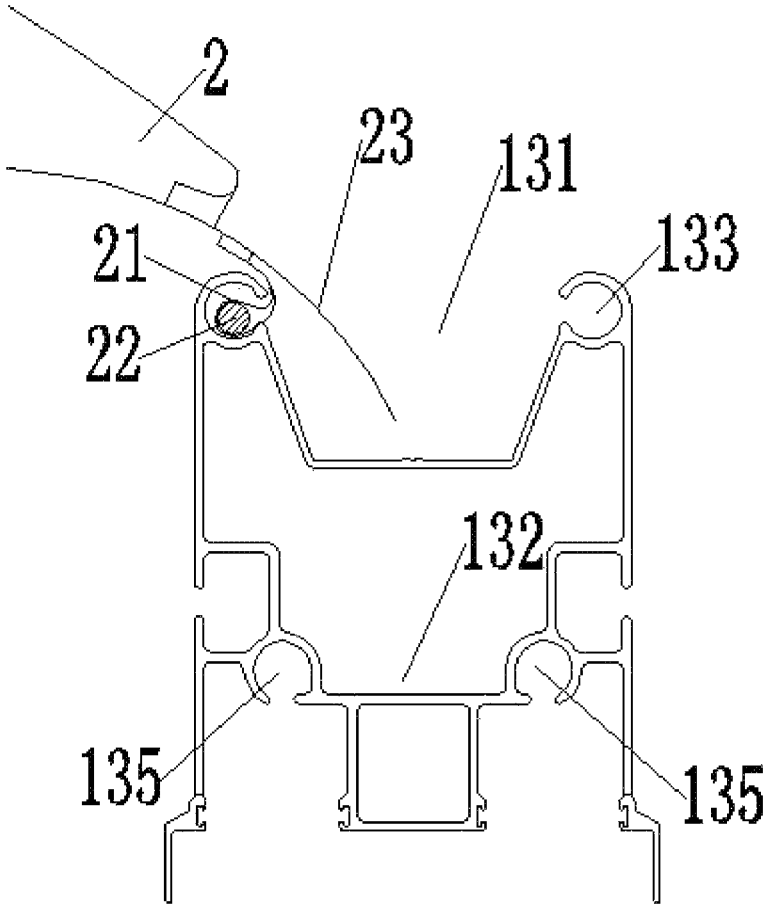
FIG. 7 is a schematic cross-sectional structural diagram of the beam.
Figure 8:
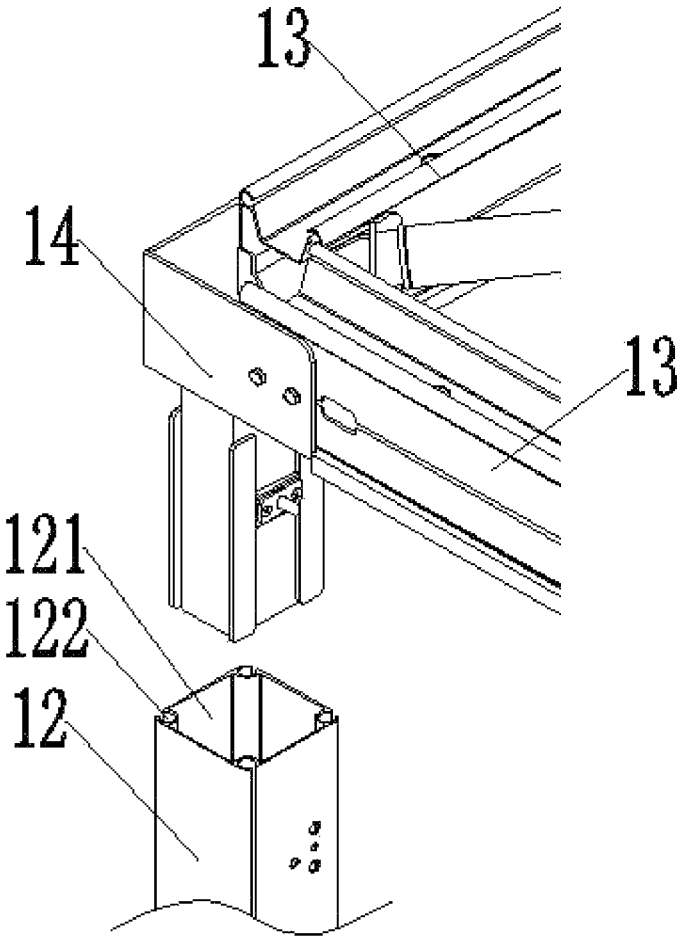
FIG. 8 is a schematic assembly structure diagram of the beam, a transition connector and a column.
Figure 9:
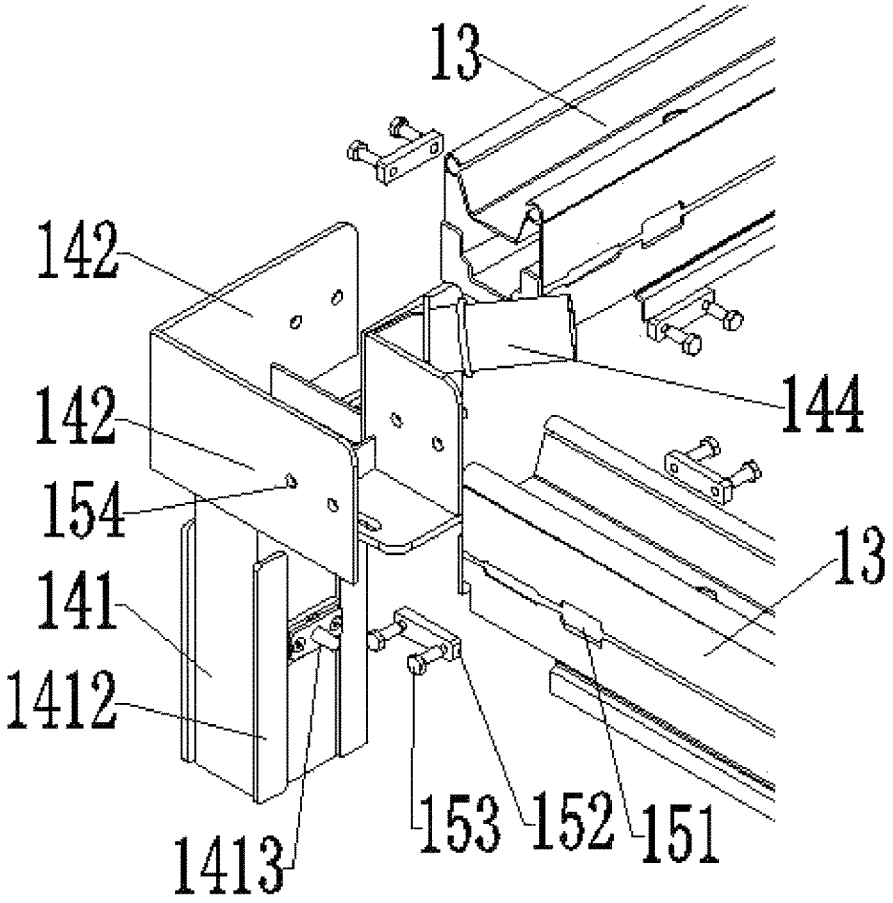
FIG. 9 is a schematic exploded structure diagram of the beam and the transition connector.
Figure 10:
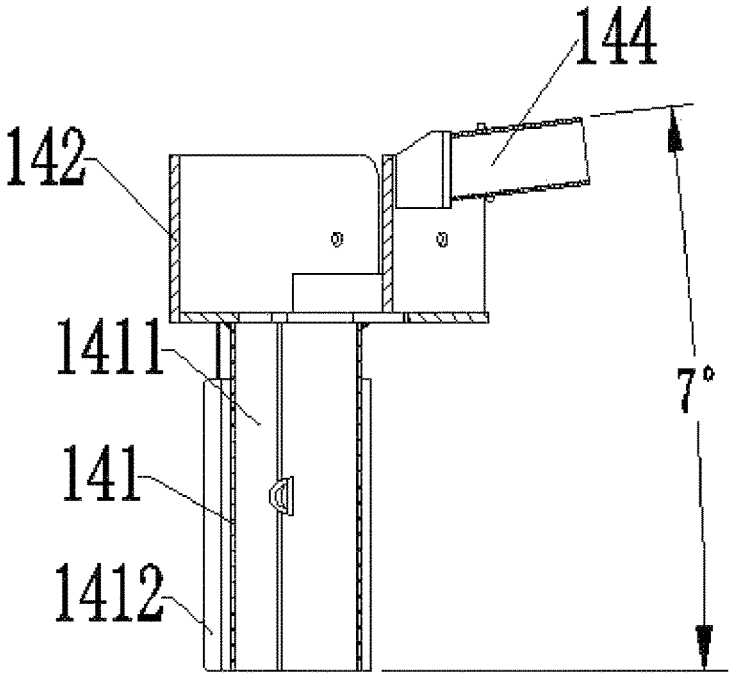
FIG. 10 is a schematic cross-sectional structural side view of the transition connector.
Figure 11:
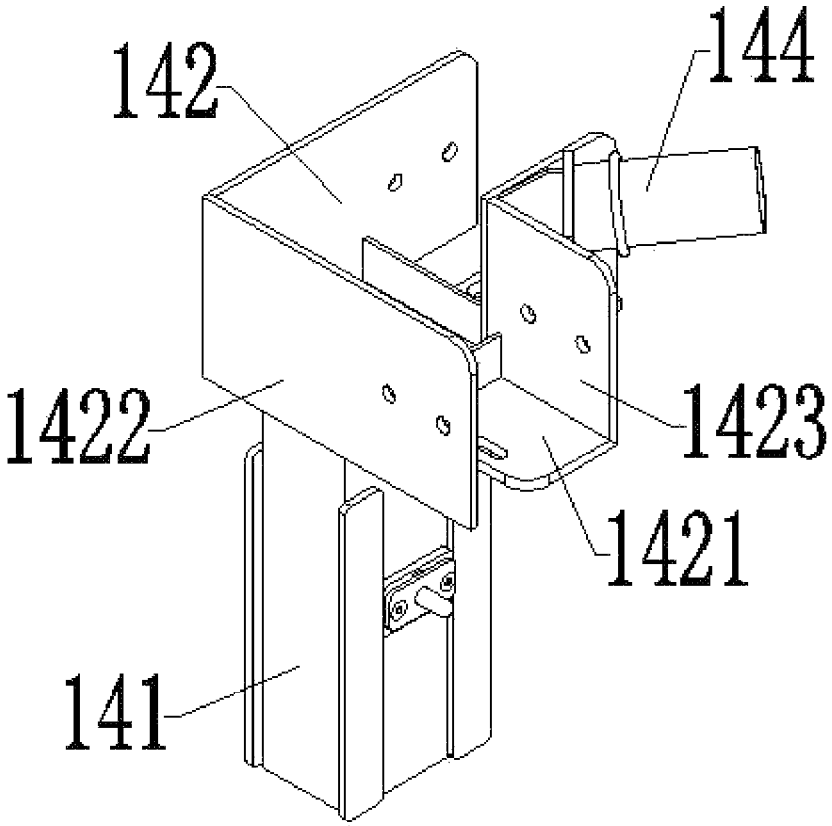
FIG. 11 is a schematic structural diagram of the transition connector.

Referring to FIG. 6 and FIG. 7, FIG. 6 is a schematic structure stereogram of the beam (13), and FIG. 7 is a schematic cross-sectional structural diagram of the beam (13). The beam (13) is provided with at least a first water channel (131) and a second water channel (132) in a length direction. The first water channel (131) is disposed on an upper surface of the beam (13). Two sides of the first water channel (131) are provided with tarpaulin top clamping positions (133). The tarpaulin top clamping positions (133) are disposed at top ends of the two sides of the first water channel (131), and the tarpaulin top clamping positions (133) are configured to mount a tarpaulin (2) such that water on the tarpaulin (2) flows into the first water channel (131) along the tarpaulin. The shape of a concave surface of the first water channel (131) is a trapezoid, and the shape trapezoid facilitates confluence of water. The second water channel (132) is disposed in the beam (13) and located below the first water channel (131), and a plurality of water leakage holes (134) are formed in a bottom surface of the first water channel (131) at intervals, so that water can flow into the second water channel (132) from the first water channel (131) via the water leakage holes (134). In addition, the beam (13) further includes curtain clamping positions (135). The shape of a concave surface of the second water channel (132) is larger at the top and smaller at the bottom and is similar to a trapezoid, and the curtain clamping positions (135) are disposed at bottom ends of two outer sides of the second water channel (132).

Figure 12:
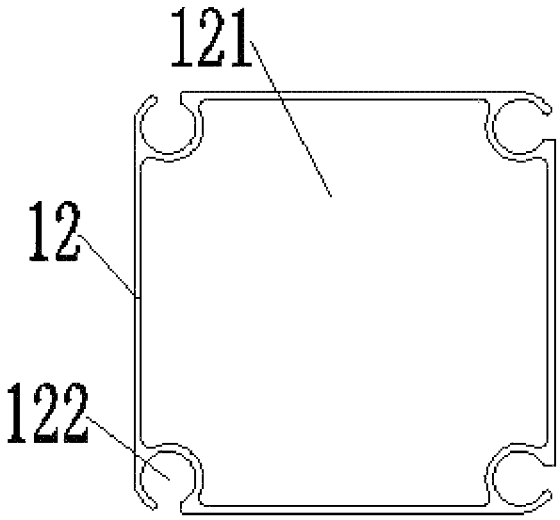
FIG. 12 is a schematic cross-sectional structural diagram of the column.

Referring to FIG. 12, FIG. 12 is a schematic cross-sectional structural diagram of the column (12). A third water channel (121) is disposed in the column (12) in a length direction, and four corners of the column (12) are further provided with curtain clamping positions (122).

Figure 22:
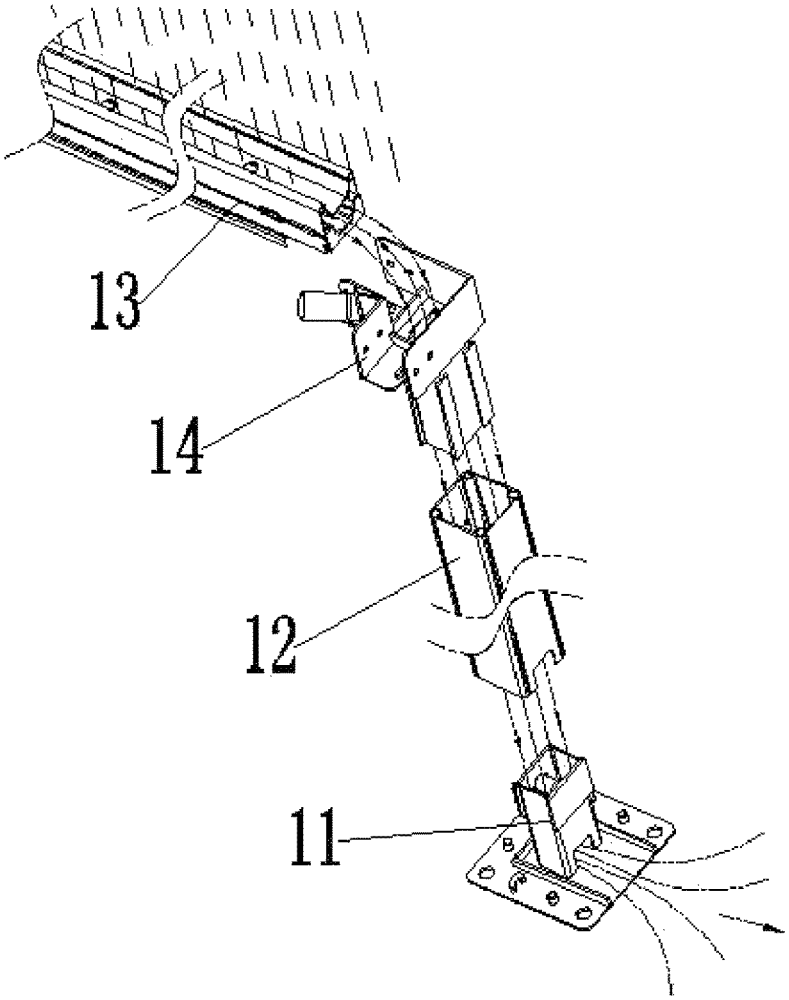
FIG. 22 is a schematic diagram of a flow direction of water at the beam, the transition connector and the column.

Referring to FIG. 22, the beam (13) is connected to a top end of the column (12) through a transition connector (14), so that water sequentially flows through the first water channel (131), the second water channel (132), a transition water channel (1411) and the third water channel (121), that is, the water on the tarpaulin (2) is sequentially guided through the beam (13), the transition connector (14), the column (12) and the base (11).

In another preferred embodiment, referring to FIG. 8 to FIG. 11, FIG. 8 is a schematic assembly diagram of A in FIG. 5. The beam (13) is connected to the column (12) through a transition connector (14). The transition connector (14) includes a vertical insertion portion (141), horizontal insertion portions (142) and tent top insertion portions (144). A transition water channel (1411) is disposed in the vertical insertion portion (141) in a length direction, with its lower end forming an insertion with the column (12). In the present embodiment, the vertical insertion portion (141) is inserted into an inner cavity of the column (12) to form an insertion, and four corners of the vertical insertion portion (141) are respectively provided with a clamping plate (1412) for resisting an inner side wall of the column (12) and enhancing the stability of the insertion. A surface of the vertical insertion portion (141) is provided with a spring pin (1413) for pressing against an inner surface of the column (12).

Referring to FIG. 8 to FIG. 11, the horizontal insertion portion (142) includes a bottom plate (1421), a first side plate (1422) and a second side plate (1423). The bottom plate (1421) is disposed at a side edge of the vertical insertion portion (141) to support the beam (13), and the first side plate (1422) and the second side plate (1423) are respectively disposed on two sides of the bottom plate (1421). In the present embodiment, the number of the horizontal insertion portions (142) is two, and the horizontal insertion portions are respectively disposed at two adjacent sides of a top end of the vertical insertion portion (141) to respectively form an insertion with the beam (13). After the two beams (13) are respectively inserted at the two horizontal insertion portions (142) in place, a fastening assembly is used to fixedly connect the vertical insertion portion (141) to the beam (13). The fastening assembly includes a double-hole square nut (152) and a bolt (153). The side surface of the beam (13) is provided with a milling opening (151), and the first side plate (1422) is provided with double holes (154). The double-hole square nut (152) is mounted on an inner side surface of the beam (13) to correspond to the milling opening (151), and the bolt (153) sequentially runs through the double holes (154) and the milling opening (151) and is connected to the double-hole square nut (152), thereby completing the fixation. The other side surface of the beam (13) and the second side plate (1423) similarly use the above fastening assembly to complete the fixation and mounting in the same manner.

Referring to FIG. 8 to FIG. 11, edges of the second side plates (1423) of the two horizontal insertion portions (142) are connected to each other, and the tent top insertion portion (144) is disposed at a connection of the two second side plates (1423) at a preset angle. The preset angle is set according to the actual tent top height, and in the square tent group, the preset angle is 7°.

Figure 13:
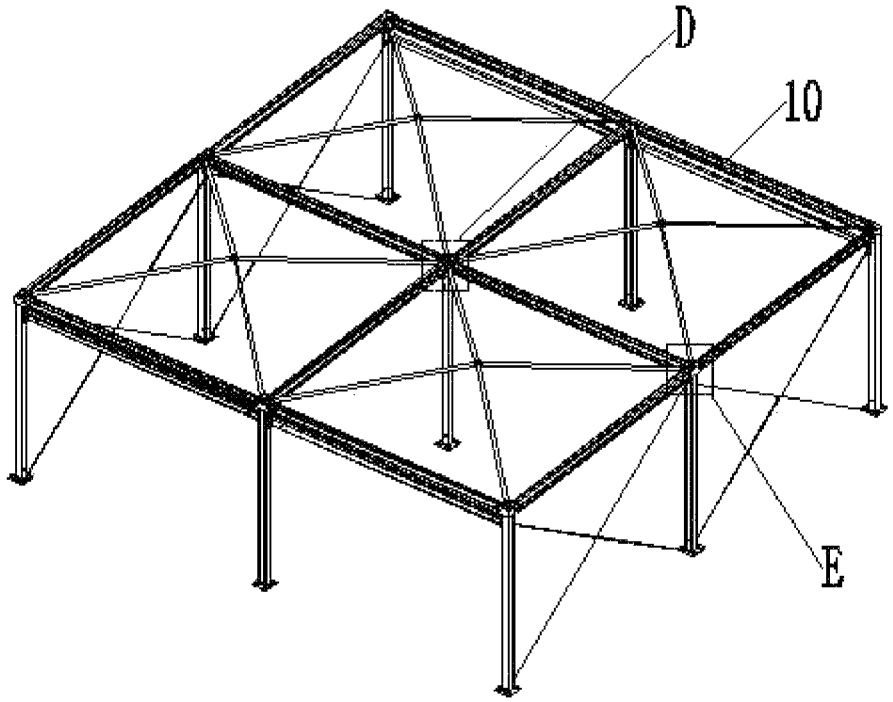
FIG. 13 is a schematic structural diagram of a tent frame of a square tent group.

In a single unit tent (100), the structure of the transition connectors (14) at the four corners are described above. In a tent group with more than two rows and two columns of unit tents, as shown in FIG. 13, every two adjacent tent frames (10) share the beams (13) and the columns (12), and one of the columns (12) is provided with at least four of the beams (13). The tarpaulin (2) is mounted on the tent frame (10), and an edge of the tarpaulin (2) is located above the first water channel (131). The adjacent unit tents (100) share the edge structure, so the shared edge structures of the tent group may be in a corner position, a middle position and an outer wall position. The corner position is at the corner, and the two adjacent sides are connected to the beam (13), as shown at A in FIG. 5. The middle position is at the center, and four side surfaces are all connected to the beams (13), as shown at D in FIG. 13. The outer wall position is located at the edge but not at the corner, and three side surfaces are all connected to the beams (13), as shown at E in FIG. 13. In the different positions above, the basic structure of the transition connector (14) remains unchanged. One transition connector (14) is provided with one vertical insertion portion (141), and the numbers of the horizontal insertion portions (142) and the tent top insertion portions (144) are set according to the actual position. In a case where a plurality of horizontal insertion portions (142) are disposed, the basic components of the horizontal insertion portion (142) may be slightly transformed when the edge structure can be shared.

Figure 14:
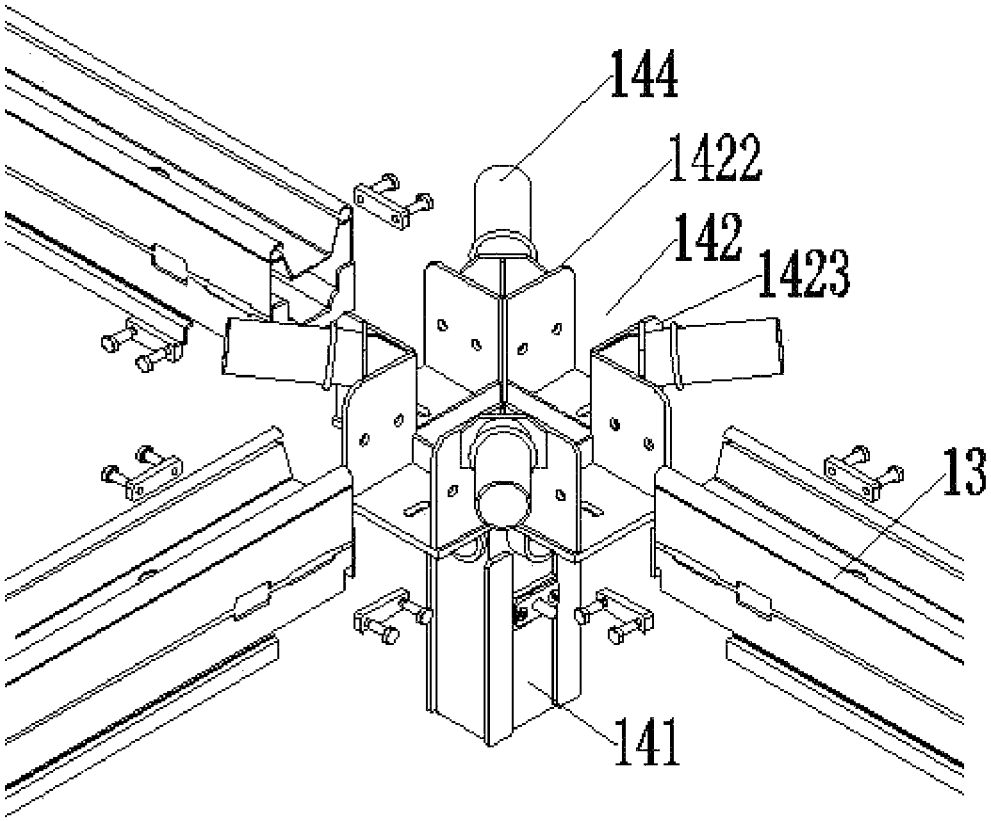
FIG. 14 is a schematic exploded structure diagram of D in FIG. 13.

Specifically, referring to FIG. 13 and FIG. 14, the structure of the transition connector (14) in the middle position is shown in FIG. 14. One transition connector (14) is provided with one vertical insertion portion (141), four horizontal insertion portions (142) and four tent top insertion portions (144). The four horizontal insertion portions (142) are respectively disposed at four side edges at a top end of the vertical insertion portion (141) to be connected to the four beams (13). Each of the horizontal insertion portions (142) is provided with a first side plate (1422) and a second side plate (1423). The tent top insertion portion (144) is disposed between the first side plate (1422) of one of the horizontal insertion portions (142) and the second side plate (1423) of the adjacent horizontal insertion portion (142). The four tent top insertion portions (144) are respectively disposed between the first side plate (1422) and the second side plate (1423) of every two adjacent horizontal insertion portions (142).

Figure 15:
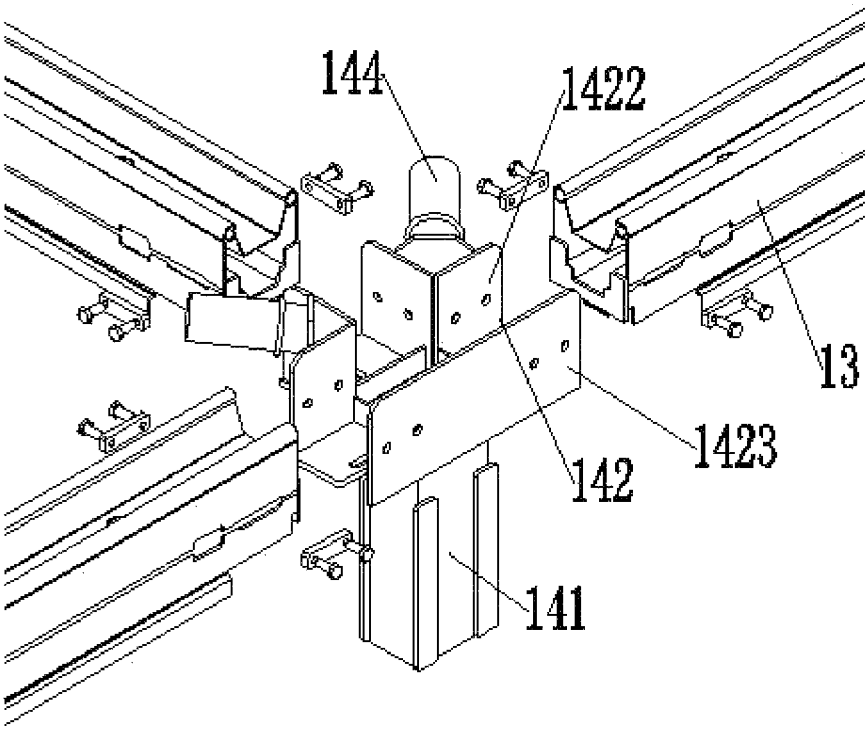
FIG. 15 is a schematic exploded structure diagram of E in FIG. 13.
Figure 16:
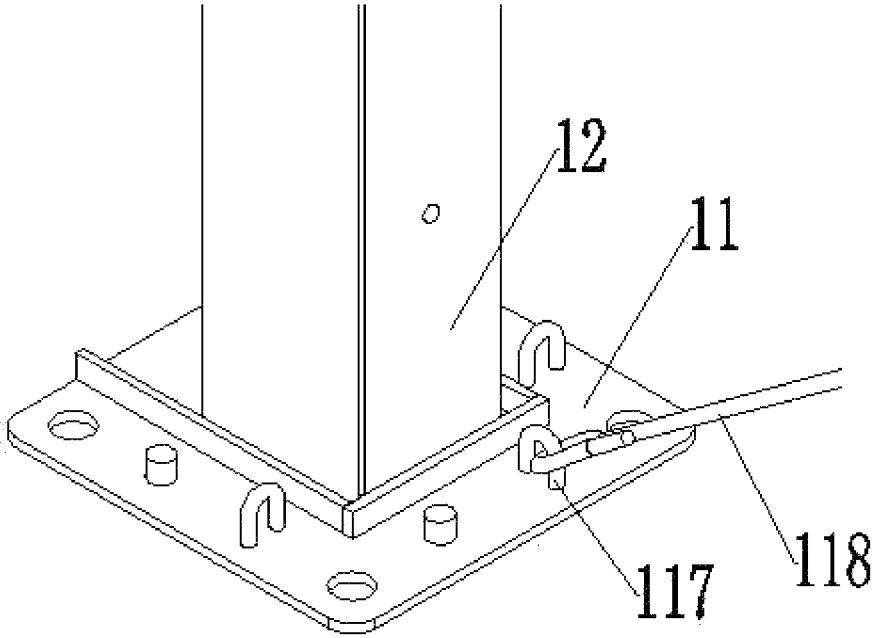
FIG. 16 is a schematic enlarged structure diagram of B in FIG. 5.
Figure 17:
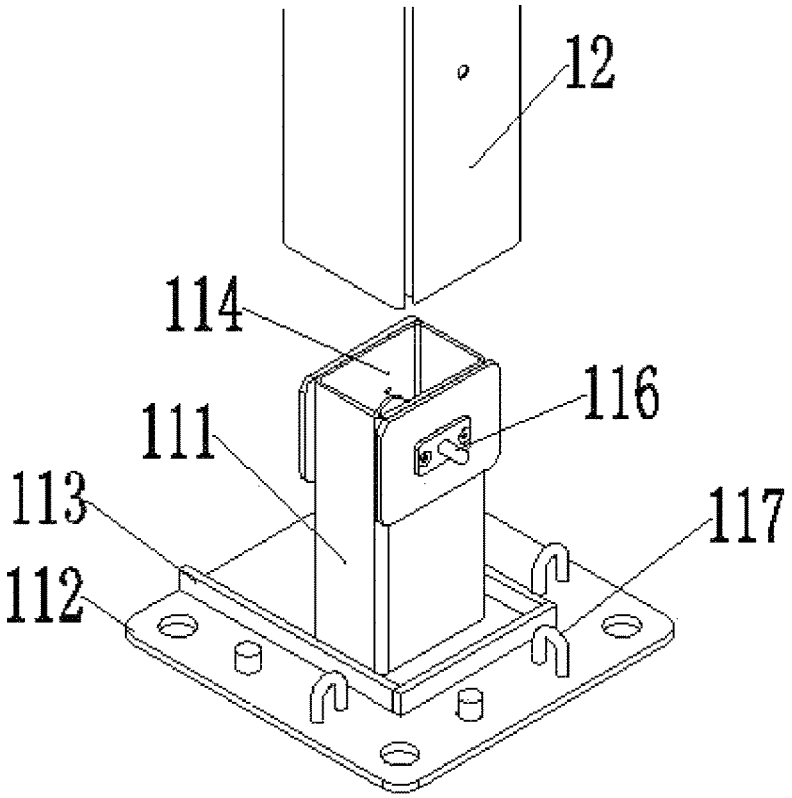
FIG. 17 is a schematic assembly structure diagram of the column and a base.
Figure 18:
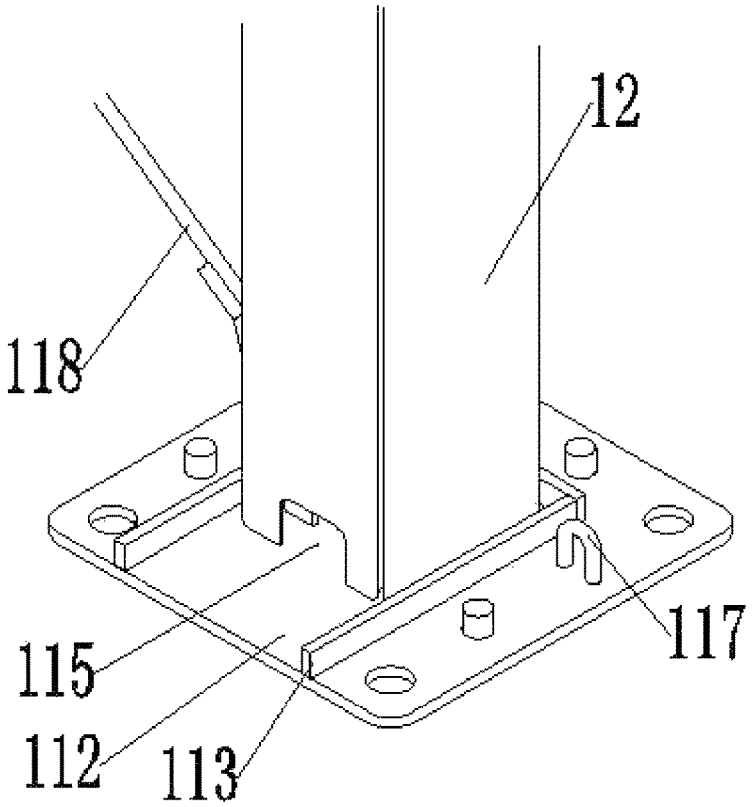
FIG. 18 is a schematic structural diagram of the column and the base in another direction.
Figure 19:
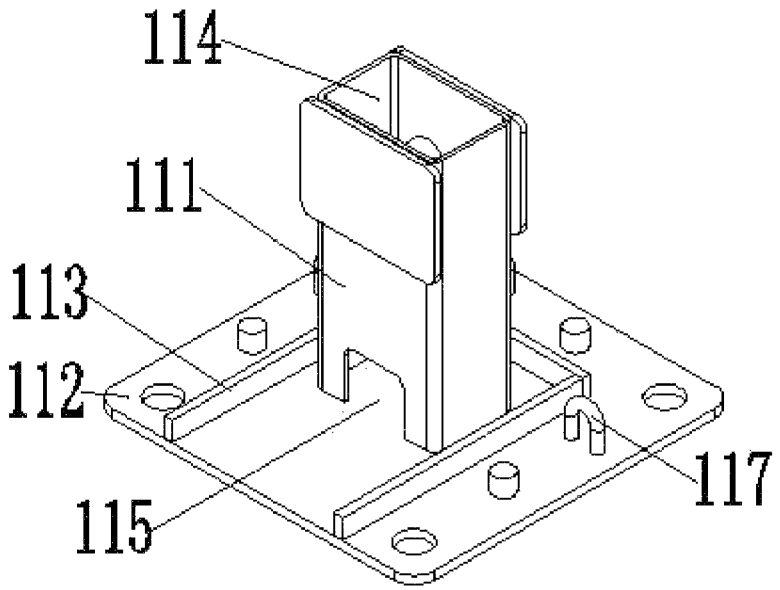
FIG. 19 is a schematic structural diagram of the base.
Figure 20:
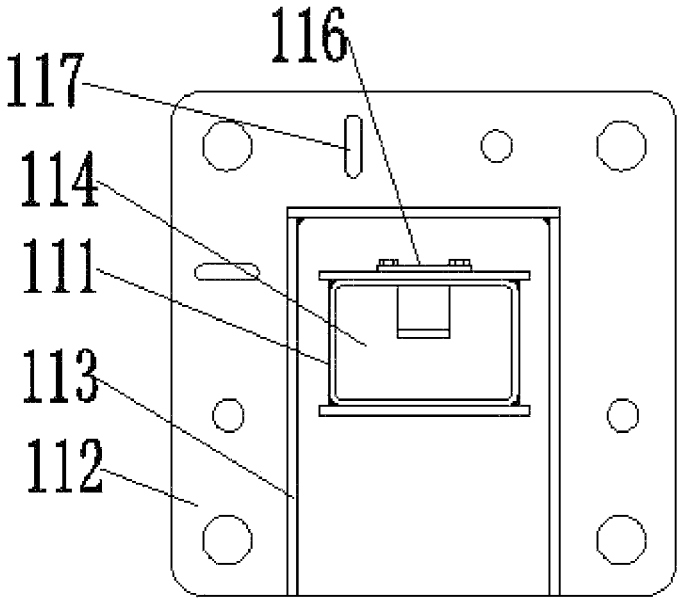
FIG. 20 is a schematic structural top view of the base.
Figure 21:
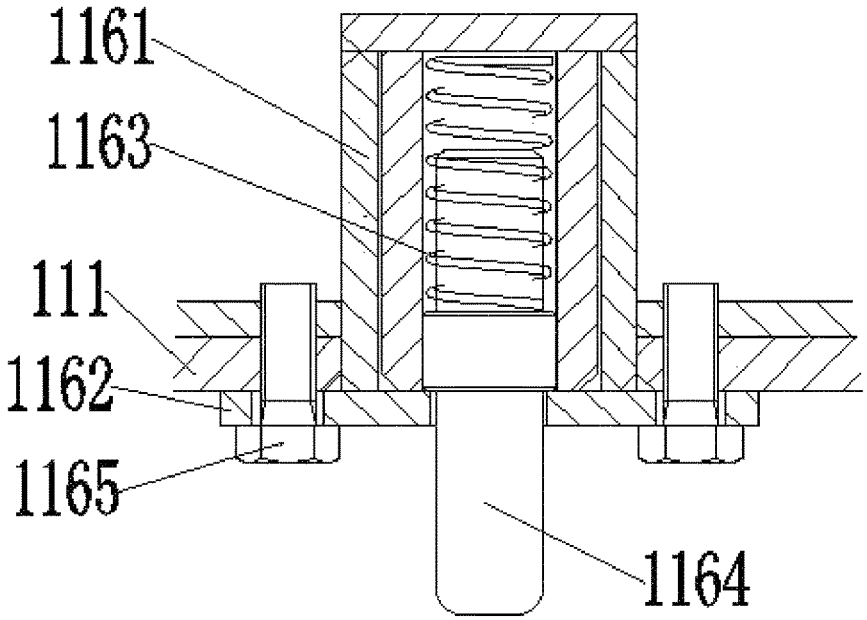
FIG. 21 is a schematic cross-sectional structural diagram of a spring pin assembly.

Specifically, referring to FIG. 13 and FIG. 15, the structure of the transition connector (14) in the external wall position is shown in FIG. 15. One transition connector (14) is provided with one vertical insertion portion (141), three horizontal insertion portions (142) and two tent top insertion portions (144). The three horizontal insertion portions (142) are respectively disposed at three side edges at a top end of the vertical insertion portion (141) to be connected to the three beams (13). Each of the horizontal insertion portions (142) is provided with a first side plate (1422) and a second side plate (1423). The tent top insertion portion (144) is disposed between the first side plate (1422) of one of the horizontal insertion portions (142) and the second side plate (1423) of the adjacent horizontal insertion portion (142). The two tent top insertion portions (144) are respectively disposed between the first side plate (1422) and the second side plate (1423) of every two adjacent horizontal insertion portions (142). At the same time, for the two horizontal insertion portions (142) at opposite positions, the first side plate (1422) of one of the horizontal insertion portion (142) is connected to the edge of the second side plate (1423) of the other horizontal insertion portion (142) to form a plane.

Specifically, referring to FIG. 16 to FIG. 20, FIG. 16 is an enlarged diagram of B in FIG. 5. The base (11) includes a pedestal (111), a base plate (112) and a water retaining plate (113). The pedestal (111) is disposed on the base plate (112). A fourth water channel (114) is disposed in the pedestal (111) in a length direction. The pedestal (111) forms an insertion with an end portion of the column (12). The port of the third water channel (121) communicates with a port of the fourth water channel (114). The port of the fourth water channel (114) communicates with and extends to a bottom of the pedestal (111) to form a water outlet (115). The water retaining plate (113) is disposed on the base plate (112) and surrounds an edge of the pedestal (111) except for the position of the water outlet. A plurality of mounting bolt holes are formed in the base plate (112) to facilitate mounting, and pull rings (117) are also provided. The side surface of the column (12) near the top end is also provided with pull rings (117), so that an X-shaped wire rope (118) can be disposed between the two columns (12), thereby enhancing the stability of the tent frame (10).

Figure 31:
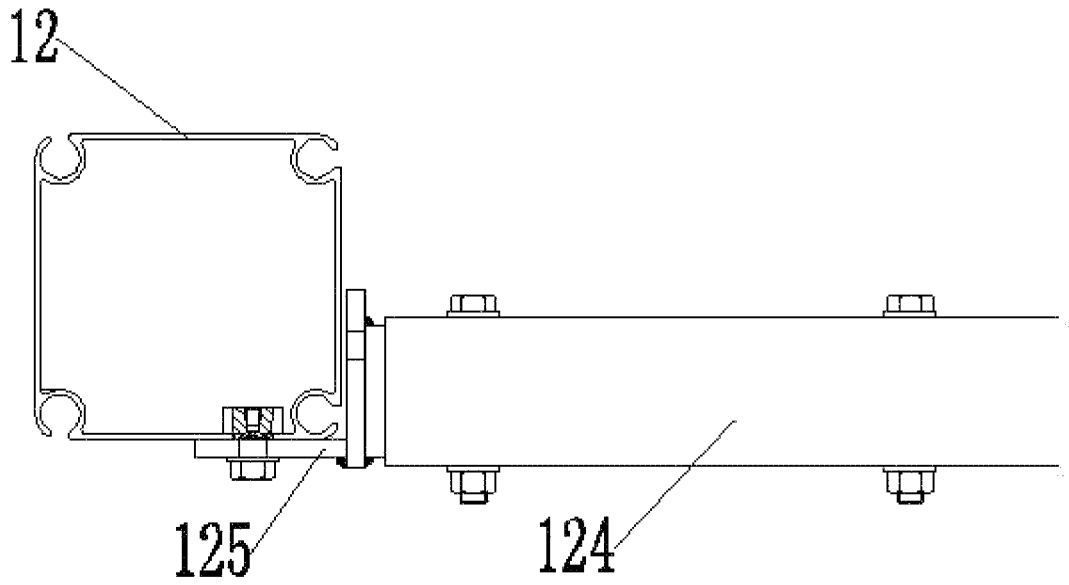
FIG. 31 is a schematic structural diagram of mounting of a reinforcing beam and a column.
Figure 32:
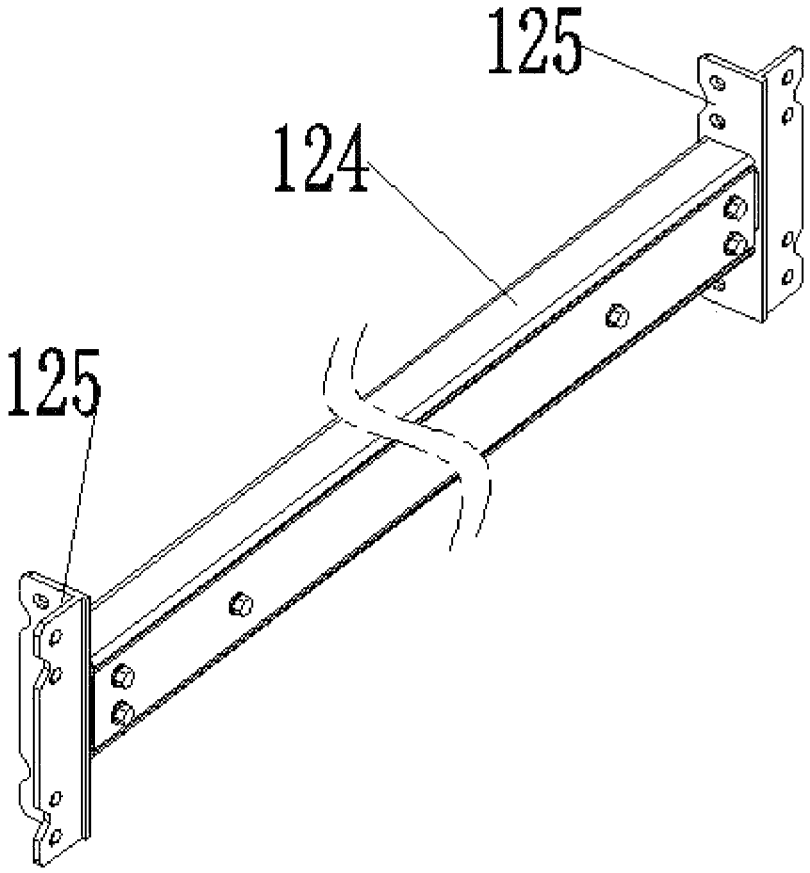
FIG. 32 is a schematic structural diagram of the reinforcing beam.

In order to further enhance the stability of the tent frame (10), a reinforcing beam (124) may further be disposed between the two columns (12). Referring to FIG. 31 and FIG. 32, the reinforcing beam (124) is an I-shaped beam, and two ends are fixed to the side surface of the column (12) through an L-shaped plate (125) to enhance the stability between the two adjacent columns (12).

Specifically, referring to FIG. 16 to FIG. 21, FIG. 21 is a schematic cross-sectional structural diagram of a spring pin assembly (116). The tent frame further includes the spring pin assembly (116). The spring pin assembly (116) includes a sleeve (1161), a pressure plate (1162), a spring (1163) and a spring dowel pin (1164). The pressure plate (1162) is disposed at a side surface of the pedestal (111) by using a bolt (1165), and a circular hole is formed in a surface of the pressure plate (1162). A port of the sleeve (1161) is connected to the pressure plate (1162) and is opposite to the circular hole, and the sleeve (1161) is located in the pedestal (111). The spring (1163) is disposed in the sleeve (1161), a rear end of the spring dowel pin (1164) is disposed in front of the spring (1163), and a front end runs through the circular hole to press against an inner surface of the column (12). The front end of the spring dowel pin (1164) is smaller in size than the circular hole, and the rear end is greater in size than the circular hole to ensure that the spring dowel pin (1164) will not be separated from the circular hole. The spring pin (1413) and the spring pin assembly (116) are similar in structure.

Figure 23:
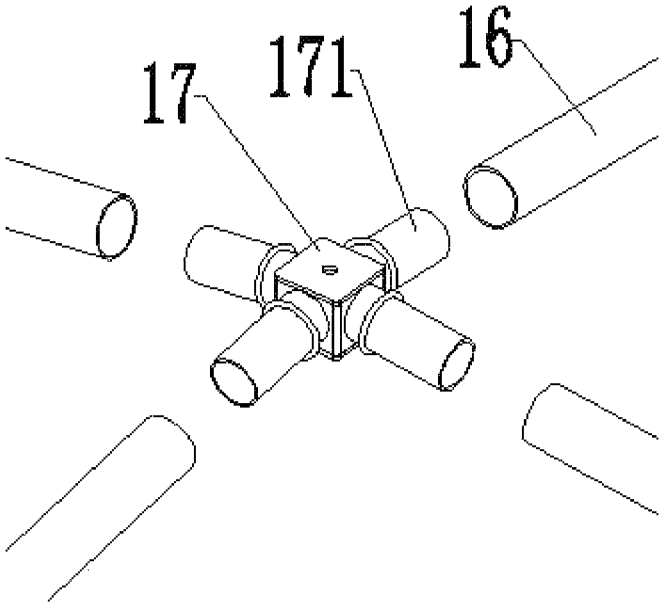
FIG. 23 is a schematic exploded structure diagram of C in FIG. 5.

In another preferred embodiment, referring to FIG. 5, the tent frame further includes tent top rods (16) and a confluence member (17). Referring to FIG. 23, FIG. 23 is a schematic assembly diagram of C in FIG. 5. The confluence member (17) is provided with a plurality of confluence positions (171) at intervals along a side surface, one end of the tent top rod (16) forms an insertion with the tent top insertion portion (144), and the other end is connected to one of the confluence positions (171) of the confluence member (17). In the present embodiment, the tent top rod (16) is a circular tube, and the side surface of the confluence member (17) is provided with four confluence positions (171) at intervals.

Figure 24:
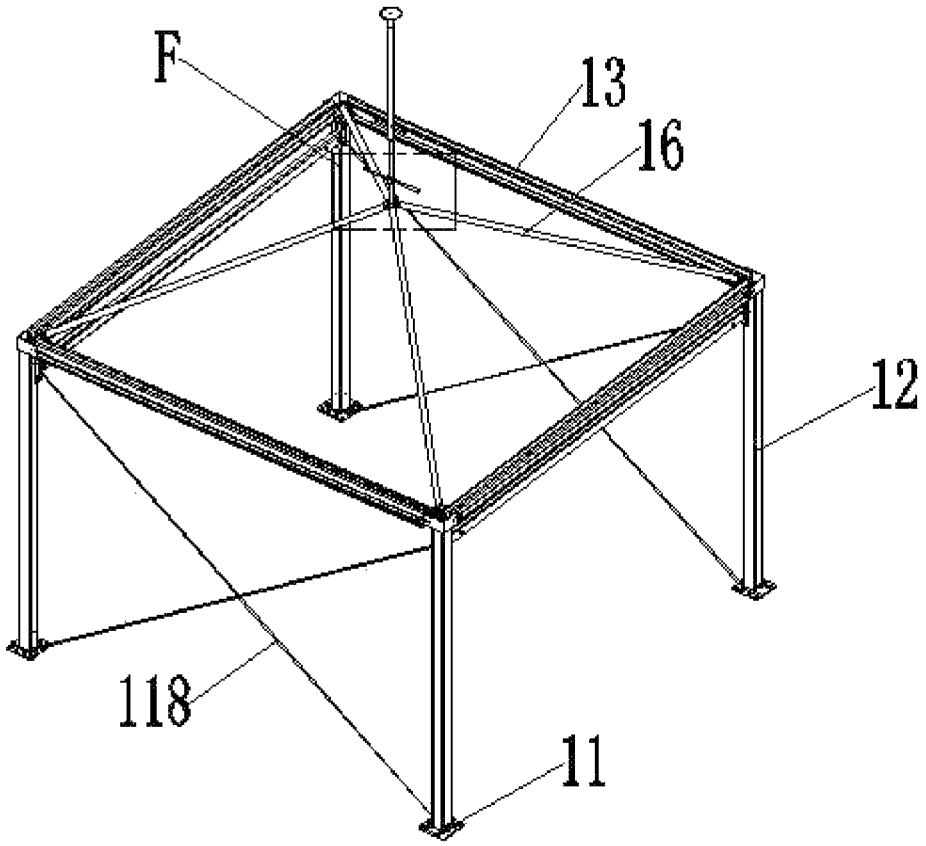
FIG. 24 is a schematic structural diagram of a tent frame of the steepletop unit tent.
Figure 25:
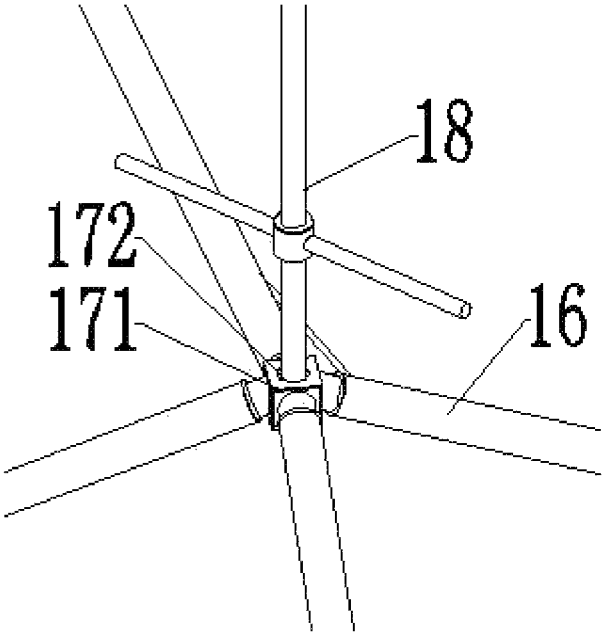
FIG. 25 is a schematic enlarged structure diagram of F in FIG. 24.
Figure 26:
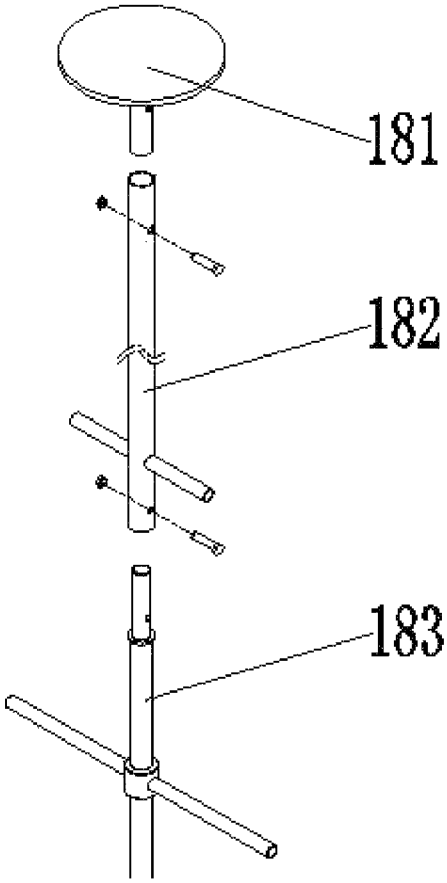
FIG. 26 is a schematic structural diagram of a propping rod.

In another preferred embodiment, referring to FIG. 24 and FIG. 25, FIG. 25 is a schematic diagram of F in FIG. 24. A top of the confluence member (17) is provided with a propping position (172), and a propping rod (18) runs through the propping position (172) to prop up a tarpaulin (2), thereby forming a steepletop tent. For the steepletop tent, the preset angle between the tent top insertion portion (144) and the second side plate (1423) is 20°. Specifically, referring to FIG. 26, the propping rod (18) includes a top tray (181), a brace rod (182) and a lifting rod (183). An upper end of the brace rod (182) is connected to the top tray (181), a lower end is connected to the lifting rod (183), and the lifting rod (183) is inserted at the propping position (172).

Figure 27:
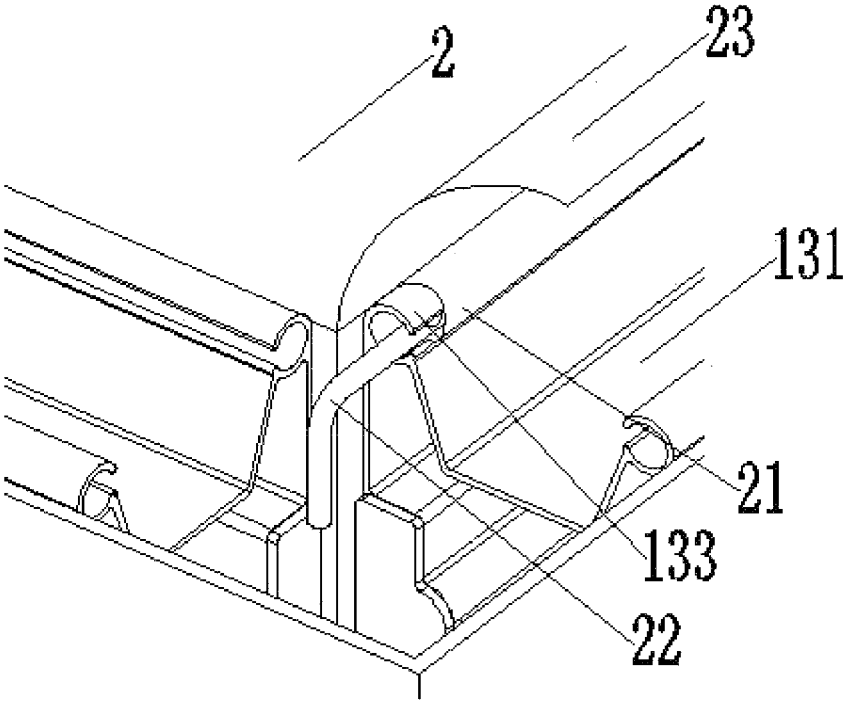
FIG. 27 is a schematic assembly structure diagram of a tarpaulin and the beam.

Specifically, referring to FIG. 7 and FIG. 27, an edge of the tarpaulin (2) is provided with a tarpaulin sleeve (21) and a tarpaulin rod (22). The tarpaulin rod (22) runs through the tarpaulin sleeve (21), and they run through the tarpaulin top clamping position (133) together such that the edge of the tarpaulin (2) is located above the first water channel (131). An edge of the tarpaulin sleeve (21) is provided with a lappet (23) configured to shield the tarpaulin sleeve (21), and the lappet (23) is located above the first water channel (131), which helps guide water on the surface of the tarpaulin (2) to the first water channel (131) and prevent the water from penetrating into the tarpaulin top clamping position (133). Preferably, the tarpaulin (2) is an inflatable tarpaulin.

Figure 28:
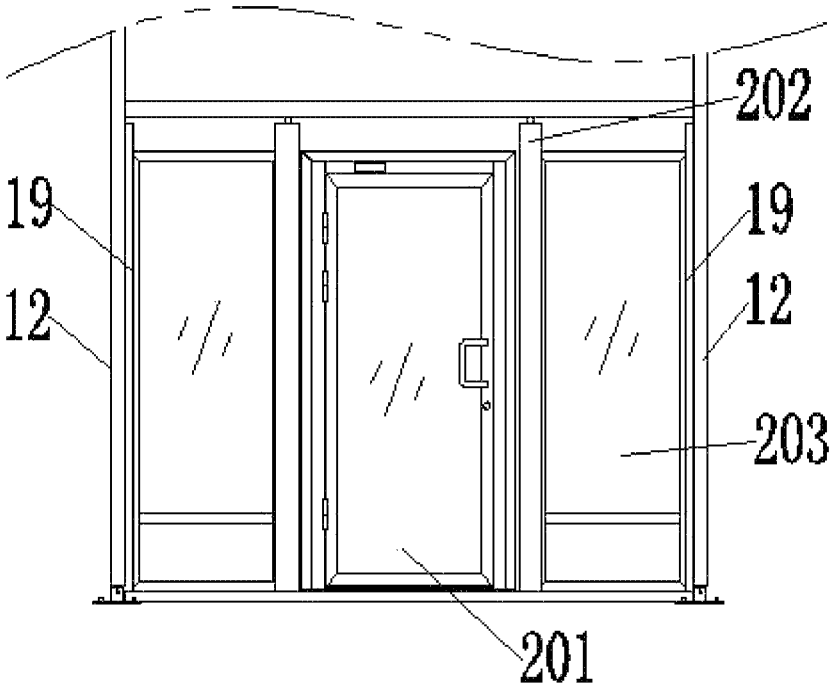
FIG. 28 is a schematic assembly structure diagram of a wall panel and the columns.
Figure 29:
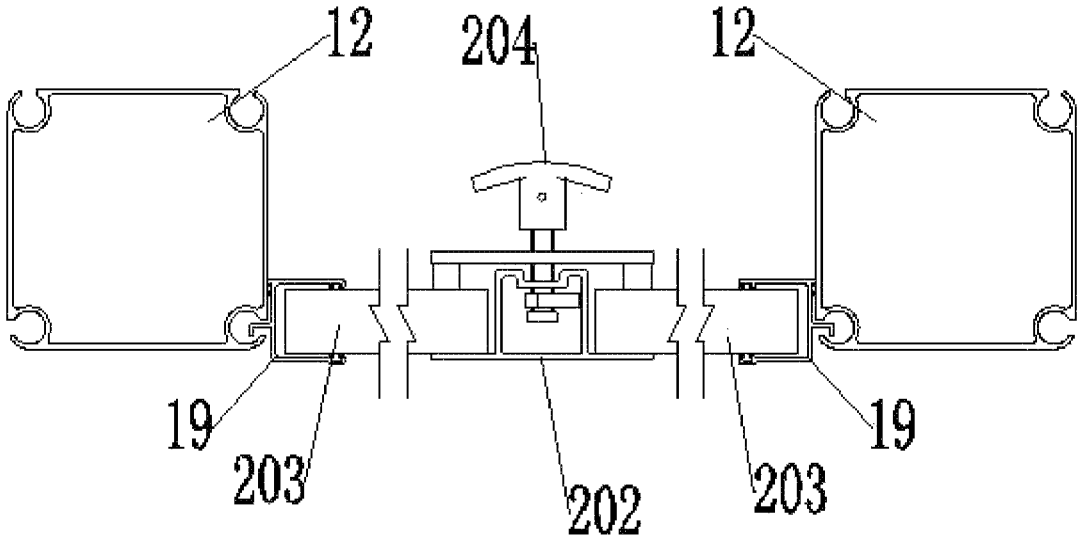
FIG. 29 is a schematic assembly cross-sectional structure diagram of the wall panel and the columns.
Figure 30:
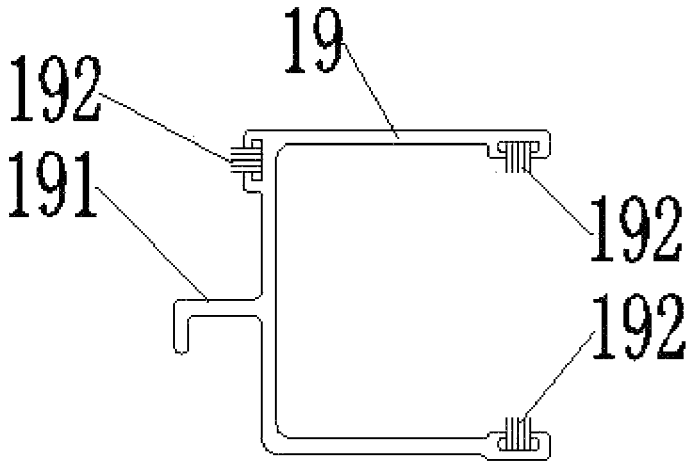
FIG. 30 is a schematic cross-sectional structural diagram of a wall panel connector.

Specifically, referring to FIG. 28 to FIG. 30, the unit tent further includes wall panel connectors (19). The wall panel connectors (19) are respectively disposed oppositely between every two adjacent columns (12), and a wall panel is mounted between the two wall panel connectors (19). For the side where a door (201) needs to be mounted, a T-shaped post (202) may be used to assist in mounting the door (201), as shown in FIG. 28. For the side where no door is disposed, the wall panel may be spliced from a plurality of pieces. As shown in FIG. 29, different wall panels may be fixed and locked by a locking device (204), and the applicant has applied for a patent for the locking device. Specifically, the wall panel connector (19) is in a C shape, an outer side is provided with an L-shaped end (191) to form an insertion with a side surface of the column (12), an anti-scratch strip (192) is disposed at a close position of the outer side and the side surface of the column (12), and an anti-scratch strip (192) is disposed at a close position of an opening and the wall panel. The position where the anti-scratch strip (192) is disposed has a limiting effect on the wall panel, and can prevent the wall panel connector (19) from wearing or scratching the wall panel. Preferably, the wall panel may be glass or a functional sandwich panel.

The present invention provides a tent frame, a unit tent and an extendable cubic tent group. The tent group is assembled from a plurality of unit tents sharing edge structures. The unit tent consists of an inflatable tarpaulin and a tent frame having a water discharge function. According to the tent frame, the structures of the columns and the beams are simplified. The column is provided with a single water guide channel, and a water guide channel of the beam is set as two layers communicating with each other and is in a shape of a trapezoid. The tent frame is simple in structure, but is more beneficial to coping with the situation of large water volume. Besides, the connector of the column and the beam is made into an integrated structure according to different positions, which reduces the assembly of small parts during assembly and effectively enhances the stability of the structure, so that the structural weight of the overall frame is greatly reduced while the hidden water discharge function is reserved.

In the description of the specification, the description with reference to the terms "one implementation", "certain implementations", "exemplary implementations", "examples", "specific examples", "some examples" or the like means that specific features, structures, materials or characteristics described in conjunction with the implementations or examples are included in at least one implementation or example of the present invention. In the specification, the schematic representation of the above terms does not necessarily refer to the same implementation or example. Furthermore, the specific features, structures, materials or characteristics described may be combined in a suitable manner in any one or more implementations or examples.

Based on the above, although the present invention has been disclosed as above in preferred embodiments, the above preferred embodiments are not intended to limit the present invention. Those of ordinary skill in the art can make various changes and modifications without departing from the spirit and scope of the present invention. Therefore, the protection scope of the present invention is subject to the scope defined by the claims.

What is claimed is:

1. A tent frame, comprising bases, columns and beams, the base being disposed at a bottom of the column, wherein the beam is provided with at least a first water channel and a second water channel in a length direction, the first water channel is disposed on an upper surface of the beam, and two sides of the first water channel are provided with tarpaulin top clamping positions; the second water channel is disposed in the beam and located below the first water channel, and a plurality of water leakage holes are formed in a bottom surface of the first water channel at intervals;

a third water channel is disposed in the column in a length direction, the beam is disposed at a top end of the column, and ports of the first water channel and the second water channel communicate with a port of the third water channel.

2. The tent frame according to claim 1, wherein the shape of a concave surface of the first water channel is a trapezoid, and the tarpaulin top clamping positions are disposed at top ends of the two sides of the first water channel.

3. The tent frame according to claim 1, further comprising curtain clamping positions, wherein the shape of a concave surface of the second water channel is larger at the top and smaller at the bottom, and the curtain clamping positions are disposed at bottom ends of two outer sides of the second water channel.

4. The tent frame according to claim 1, wherein the beam is connected to the column through a transition connector; the transition connector comprises a vertical insertion portion, horizontal insertion portions and tent top insertion portions; a transition water channel is disposed in the vertical insertion portion in a length direction, with its lower end forming an insertion with the column; the number of the horizontal insertion portions is at least two, and the horizontal insertion portions are disposed at side edges of a top end of the vertical insertion portion to form an insertion with the beam; and the tent top insertion portion is disposed at a connection between two adjacent horizontal insertion portions, and an opening faces the inside of the tent frame.

5. The tent frame according to claim 4, wherein the horizontal insertion portion comprises a bottom plate, a first side plate and a second side plate; and the bottom plate is disposed at the side edge of the vertical insertion portion to support the beam, and the first side plate and the second side plate are respectively disposed on two sides of the bottom plate.

6. The tent frame according to claim 1, wherein the base comprises a pedestal, a base plate and a water retaining plate; and the pedestal is disposed on the base plate, a fourth water channel is disposed in the pedestal in a length direction, the pedestal forms an insertion with an end portion of the column, the port of the third water channel communicates with a port of the fourth water channel, the port of the fourth water channel extends to a bottom of the pedestal to form a water outlet, and the water retaining plate is disposed on the base plate and surrounds an edge of the pedestal except for the position of the water outlet.

7. The tent frame according to claim 6, further comprising a spring pin assembly, wherein the spring pin assembly comprises a sleeve, a pressure plate, a spring and a spring dowel pin; the pressure plate is disposed at a side surface of the pedestal, and a circular hole is formed in a surface of the pressure plate; a port of the sleeve is connected to the pressure plate and is opposite to the circular hole, and the sleeve is located in the pedestal; and the spring is disposed in the sleeve, a rear end of the spring dowel pin is disposed in front of the spring, and a front end runs through the circular hole to press against an inner surface of the column.

8. The tent frame according to claim 1, further comprising tent top rods and a confluence member, wherein the confluence member is provided with a plurality of confluence positions at intervals along a side surface, one end of the tent top rod forms an insertion with the tent top insertion portion, and the other end is connected to one of the confluence positions of the confluence member.

9. The tent frame according to claim 8, wherein a top of the confluence member is provided with a propping position, and a propping rod runs through the propping position to prop up a tarpaulin; the propping rod comprises a top tray, a brace rod and a lifting rod; and an upper end of the brace rod is connected to the top tray, a lower end is connected to the lifting rod, and the lifting rod is inserted at the propping position.

10. A unit tent, comprising a tent frame and a tarpaulin, wherein the tent frame uses the tent frame according to claim 1; an edge of the tarpaulin is provided with a tarpaulin sleeve and a tarpaulin rod; and the tarpaulin rod runs through the tarpaulin sleeve, and they run through the tarpaulin top clamping position together such that the edge of the tarpaulin is located above the first water channel.

11. The unit tent according to claim 10, wherein the tarpaulin is an inflatable tarpaulin; and an edge of the tarpaulin sleeve is provided with a lappet configured to shield the tarpaulin sleeve, and the lappet is located above the first water channel.

12. The unit tent according to claim 10, further comprising wall panel connectors, wherein the wall panel connectors are respectively disposed oppositely between every two adjacent columns, and a wall panel is mounted between the two wall panel connectors; and the wall panel connector is in a C shape, an outer side is provided with an L-shaped end to form an insertion with a side surface of the column, an anti-scratch strip is disposed at a close position of the outer side and the side surface of the column, and an anti-scratch strip is disposed at a close position of an opening and the wall panel.

13. An extendable cubic tent group, comprising a plurality of tarpaulins and a plurality of tent frames, wherein the tent frame uses the tent frame according to claim 1, every two adjacent tent frames share the beams and the columns, and one of the columns is provided with at least four of the beams; and the tarpaulin is mounted on the tent frame, and an edge of the tarpaulin is located above the first water channel.

* * * * *